US010492274B2

(12) United States Patent
De Bruijn et al.

(10) Patent No.: US 10,492,274 B2
(45) Date of Patent: Nov. 26, 2019

(54) CAMERA-BASED CALIBRATION OF AN AMBIENCE LIGHTING SYSTEM

(71) Applicant: PHILIPS LIGHTING HOLDING B.V., Eindhoven (NL)

(72) Inventors: Frederik Jan De Bruijn, Eindhoven (NL); Tommaso Gritti, Eindhoven (NL); Stephanus Joseph Johannes Nijssen, Eindhoven (NL); Lorenzo Feri, Eindhoven (NL); Wei Pien Lee, Eindhoven (NL); Maarten Marinus Johannes Wilhelmus Van Herpen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 87 days.

(21) Appl. No.: 14/891,264

(22) PCT Filed: May 2, 2014

(86) PCT No.: PCT/EP2014/058976
§ 371 (c)(1),
(2) Date: Nov. 13, 2015

(87) PCT Pub. No.: WO2014/184009
PCT Pub. Date: Nov. 20, 2014

(65) Prior Publication Data

US 2016/0081164 A1 Mar. 17, 2016

(30) Foreign Application Priority Data

May 16, 2013 (EP) ..... 13168024

(51) Int. Cl.
*H05B 37/02* (2006.01)

(52) U.S. Cl.
CPC ..... *H05B 37/0227* (2013.01); *H05B 37/029* (2013.01)

(58) Field of Classification Search
CPC ..... H05B 37/029; H05B 37/0227; H04B 10/11–116
(Continued)

(56) References Cited

U.S. PATENT DOCUMENTS 7,932,953 B2 * 4/2011 Gutta ..... H04N 9/73 348/602
8,248,467 B1 8/2012 Ganick
(Continued)

FOREIGN PATENT DOCUMENTS

CN 101682790 A 3/2010
CN 102027807 A 4/2011
(Continued)

*Primary Examiner* — Seokjin Kim
(74) *Attorney, Agent, or Firm* — Daniel J. Piotrowski

(57) ABSTRACT

A method for calibrating an ambience lighting system for providing an ambient light effect for a cinema display screen is proposed. The method is based on implementing the ambience lighting system in the form of one or more of coded light (CL) sources. The method then includes processing one or more images of a scene being illuminated by the ambience lighting system to determine, based on the CL embedded into the light output of the individual CL sources, color and/or an intensity of the light generated by the individual CL source. The set of control data for controlling the CL sources to provide the desired ambient light effect is then based not only on the color and/or intensity of image content to be displayed on the cinema display screen, but also on the determined color and/or intensity of the light output of the individual CL sources.

12 Claims, 6 Drawing Sheets

(58) Field of Classification Search
USPC ..... 398/103, 118–131, 172
See application file for complete search history.

(56) References Cited

U.S. PATENT DOCUMENTS

| | | | | |
|---|---|---|---|---|
| 8,374,880 | B2 | 2/2013 | Van De Sluis | |
| 8,699,887 | B1 * | 4/2014 | Rothenberg | H04B 10/116 315/158 |
| 2005/0275626 | A1 * | 12/2005 | Mueller | H05B 37/029 345/156 |
| 2010/0244745 | A1 * | 9/2010 | Wendt | A63F 13/02 315/312 |
| 2012/0098960 | A1 * | 4/2012 | Fujino | H05B 37/02 348/135 |
| 2012/0262072 | A1 * | 10/2012 | Van Herpen | H05B 37/029 315/153 |
| 2015/0249496 | A1 | 9/2015 | Muijs | |

FOREIGN PATENT DOCUMENTS

| | | | |
|---|---|---|---|
| CN | 102742359 | A | 10/2012 |
| JP | 2001343900 | A | 12/2001 |
| WO | 2004006578 | A2 | 1/2004 |
| WO | 2008001259 | A2 | 1/2008 |
| WO | 2008050281 | A1 | 5/2008 |
| WO | 2008142639 | A1 | 11/2008 |
| WO | 2009060376 | A1 | 5/2009 |
| WO | 2009093158 | A1 | 7/2009 |
| WO | 2011073877 | A1 | 6/2011 |
| WO | 2011086501 | A1 | 7/2011 |
| WO | 2011092619 | A1 | 8/2011 |
| WO | 2012127439 | A1 | 9/2012 |

* cited by examiner

CAMERA-BASED CALIBRATION OF AN AMBIENCE LIGHTING SYSTEM

CROSS-REFERENCE TO PRIOR APPLICATIONS

This application is the U.S. National Phase application under 35 U.S.C. § 371 of International Application No. PCT/EP2014/058976, filed on May 2, 2014, which claims the benefit of European Patent Application No. 13168024.1, filed on May 16, 2013. These applications are hereby incorporated by reference herein.

FIELD OF THE INVENTION

Embodiments of the present invention relate generally to the field of ambience lighting systems, and, more specifically, to systems and methods for automatic calibration of such ambience lighting systems.

DESCRIPTION OF THE RELATED ART

In recent years, so-called Ambilight TV systems have been very popular amongst TV buyers. Such Ambilight systems generate light based on incoming video signals so that the wall(s) surrounding the TV set are illuminated with a background light that matches the video being shown, resulting in a larger virtual screen and a more immersive viewing experience.

An example of such an Ambilight system is disclosed in WO 2011/073877 (Van Herpen et. al.), providing a system that can dynamically extend the content projected on a cinema screen to the extra space specifically available in a cinema, such as e.g. walls, floor, and ceiling, taking into the account the knowledge about image content that is being shown on the cinema screen or that will be shown. Van Herpen describes the ambient light effect that can be provided by such a system by illustrating three states of a colored car approaching from the left hand side of the cinema display screen and moving towards the right hand side of the cinema display screen. In the first state, the car is not shown on the cinema display screen, but a selective set of the plurality of light sources arranged on the left hand side of the cinema display screen will emit light of a color matching the color of the car. In the second state, the car is shown on the cinema display screen without any or only with a support of a small set of the portion of plurality of light sources arranged surrounding the cinema display screen, followed by the third state where the car once again is not shown on the cinema display screen, but where a selective set of the plurality of light sources arranged on the right hand side of the cinema display screen will emit light of a color matching the color of the car. In this manner, the movement of the car from the left hand side of the cinema display screen to the right hand side of the cinema display screen is effectively extended in time, thus enhancing the visual experience for the spectators.

Even though the system of Van Herpen provides interesting features for enhancing the ambient lighting experience when viewing videos or images on a cinema screen, it may be desirable to provide further improvements, in particular those related to the calibration of the system.

SUMMARY OF THE INVENTION

One object of the invention is to enable automatic calibration of an ambient lighting system. A further object of the invention is to ensure that the automatic calibration can be carried out using common place devices such as cameras included e.g. in mobile phones or tablet computers.

According to one aspect of the invention, a method for calibrating an ambience lighting system is proposed. The ambience lighting system comprises at least a first light source for providing an ambient light effect in an environment comprising the ambience lighting system and a cinema display screen. The first light source is a so-called "coded light source", configured for providing a first light output comprising a first code, the first code being embedded into the first light output as a first sequence of modulations in one or more characteristics thereof. After obtaining one or more images of a scene being illuminated by the ambience lighting system, the scene comprising at least a footprint of the first light output, the method comprises the step of processing the one or more images to determine, based on the first code embedded into the first light output, at least one of a color and an intensity of the first light output provided by the first light source. The method also comprises the steps of determining at least one of a color and an intensity of an image content to be displayed on the cinema display screen and determining a set of control data for controlling the first light source to provide the ambient light effect based on the determined at least one of the color and the intensity of the first light output provided by the first light source and on the determined at least one of the color and the intensity of the image content to be displayed on the cinema display screen.

As used herein, the terms "cinema display screen" or "cinema screen" are used to describe any screen, such as e.g. a TV screen or a screen in a cinema, suitable for reproducing any video content, both in form of continuous video streams as well as still video images. The expression "set of control data" is used to describe one or more control parameters for controlling the one or more light sources of the ambience lighting system, such as e.g. red-green-blue RGB driving parameters.

While the method described above refers to method steps performed for only one light source of an ambience lighting system, the first light source, analogous steps may be performed in order to calibrate additional light sources which may be present within the system. The one or more of the light sources of an ambience lighting system are sometimes referred to herein as "external luminaires" in order to emphasize that they are the light sources which are external to the "primary source" of the cinema display screen. The term "ambient light effect" may then either refer to the light effect provided by each individual external luminaire, or by the combined light effect provided by multiple external luminaires.

Embodiments of the present invention are based on several insights. First of all, embodiments are based on the realization that the particular setting in which an ambience lighting system is implemented is important and should be accounted for in order to ensure that the luminaire(s) of the system can provide correct ambient light effect(s). One aspect of a particular setting in which such a system can be implemented relates to how the light output provided by the external luminaires appears to the spectators. This appearance is largely affected by the initial settings of the external luminaires in terms of e.g. the actual color and/or intensity of the light output provided by the luminaires, as well as by factors such as e.g. the color of the surface being illuminated by the external luminaires (because the color of the reflected light is dependent on the dominant color of the illuminated surface), the distances from the external luminaires to the illuminated surface (because the intensity of the reflected light is dependent on that distance), and/or the locations of the external luminaires with respect to the cinema screen (because each luminaire needs to be driven differently based on its location with respect to the primary source, e.g. left, right, or above the cinema screen). Including, in the calibration methods described herein, the step of determining at least one of a color and an intensity of the actual light output provided by an external luminaire allows obtaining a better match of the light that can be generated by the luminaire with the desired ambient light effect because the set of control data for the luminaire may then account for the luminaire-specific correction, e.g. in terms of RGB driving parameters.

Second, embodiments of the present invention are further based on the realization that calibration of ambience lighting systems may be made relatively simple based on the recent developments that have created light sources capable of embedding data into their light output by modulating one or more characteristics of the light output in response to a data signal. Such light output is sometimes referred to as "coded light" and abbreviated as "CL" and such light sources are then referred to as "CL sources" or "CL luminaires". One scenario where CL can be applied includes luminaires embedding their identifications (IDs) and/or information indicative of their current settings in their light output. Detection systems are known where a camera of a detection system is configured to acquire one or more images of a scene illuminated by one or more CL sources and the images are subsequently processed to determine whether and what kind of light outputs of the individual CL sources are present within the scene. In the past, such systems have been particularly useful for so-called Point&Control applications where a user can utilize the detected CL to select a light source based on the source's ID and subsequently adjust the settings of the selected light source. In the embodiments of the present invention, the use of CL sources as the external luminaires of the ambience lighting system allows determination of the color and/or the intensity of the light output produced by these luminaires based on a camera acquiring one or more images of a scene illuminated by the luminaires, which color and/or intensity may then be used in determining appropriate, luminaire-specific set of control data. Utilizing the CL technology in this manner allows opening up the possibility to use commonly available smart phones and tablets as CL detectors and devices capable of carrying out the calibration of ambience lighting systems, provided that those devices are equipped with cameras, as is normally the case.

In one embodiment, the scene may further comprise the cinema display screen and the method may then further include the step of processing the one or more images to determine a location of the first light source with respect to the cinema display screen based on an image of the cinema display screen and the first light output within the one or more images. In another embodiment, the scene may not only further comprise the cinema display screen, but also the first light source. The method may then further include the step of processing the one or more images to determine a location of the first light source with respect to the cinema display screen based on an image of the cinema display screen and an image of the first light source within the one or more images. In either one of these embodiments, the set of control data for controlling the first light source may be determined based on the location of the first light source with respect to the cinema display screen.

In an embodiment, the step of determining the set of control data may comprise determining a time delay indicative of a time difference between a time instance when an instruction for controlling the first light source is provided and a time instance when the first light source provides the ambient light effect using the determined set of control data.

In various embodiments, the method may further include the step of providing an instruction for controlling the first light source to provide the ambient light effect using the determined set of control data.

According to an aspect of the present invention, a control system is disclosed. The control system comprises at least a processing unit configured for carrying out the methods described herein. In various embodiments, the processing unit may be implemented in hardware, in software, or as a hybrid solution having both hardware and software components. Such a control system may be implemented, for example, in a remote control for controlling the ambience lighting system or included in another unit such as a tablet computer (e.g. an ipad), a smart phone, a switch, or a sensor device which then may also be used for controlling the individual CL sources of the ambience lighting system.

According to an aspect of the present invention, an ambience lighting system for a cinema display screen is disclosed. The ambience lighting system comprises the control system comprising at least a processing unit configured for carrying out the methods described herein and at least a first light source connected to the control system, the first light source configured for providing a first light output comprising a first code, the first code being embedded into the first light output as a first sequence of modulations in one or more characteristics thereof.

In an embodiment, the ambient lighting system may comprise not only the first light source but a plurality of light sources each configured to emit CL and being connected to the control system, the plurality of light sources configured to provide the ambient light effect. In an embodiment, the cinema display screen may be arranged on a front wall of a structure, such as e.g. a cinema, and at least some of the light sources of the ambience lighting system may be arranged spaced apart on side walls of the structure. In some embodiments, the light source(s) of the ambient lighting system may be provided in the form of light emitting textile(s) and/or light emitting plaster(s) covering at least one of the seat(s), the wall(s), the floor, and the ceiling of the structure. In another embodiment, the light source(s) may comprise wall-washer(s).

According to an aspect of the present invention, a cinema system is disclosed. The cinema system comprises a cinema display screen for displaying an image content, a control system comprising at least a processing unit configured for carrying out the methods described herein, and at least a first light source connected to the control system, the first light source configured for providing a first light output comprising a first code, the first code being embedded into the first light output as a first sequence of modulations in one or more characteristics thereof.

In further embodiments, each one of the control system, the ambience lighting system, and the cinema system may further include a camera (i.e., any suitable light detection means) for acquiring the one or more images to be processed by the processing unit.

In an embodiment, the camera for acquiring the images to be processed may comprise a rolling-shutter image sensor, where different portions of the image sensor are exposed at different points in time, so that the first sequence of modulations (i.e., the first code) is observable as alternating stripes in said at least one of the one or more acquired images. The use of rolling-shutter image sensors for the purpose of detecting CL is described in detail in patent application WO2012/127439A1, the disclosure of which is incorporated herein by reference in its entirety. One advantage of using a rolling-shutter image sensor is that such image sensors are simpler in design and, therefore, less costly (e.g. because less chip area is needed per pixel), than image sensors that use global shutter. Another advantage is that such image sensors are the sensors that are nowdays employed in tablets and smartphones, making these commonplace devices particularly suitable for implementing embodiments of the present invention.

According to other aspects of the present invention, a computer program for carrying out the methods described herein, as well as a non-transitory computer readable storage-medium storing the computer program are provided. A computer program may, for example, be downloaded (updated) to the existing control systems (e.g. to the existing optical receivers, remote controls, smartphones, or tablet computers) or be stored upon manufacturing of these systems.

Hereinafter, an embodiment of the invention will be described in further detail. It should be appreciated, however, that this embodiment may not be construed as limiting the scope of protection for the present invention.

DETAILED DESCRIPTION

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figures 1, 2, 3, 4:
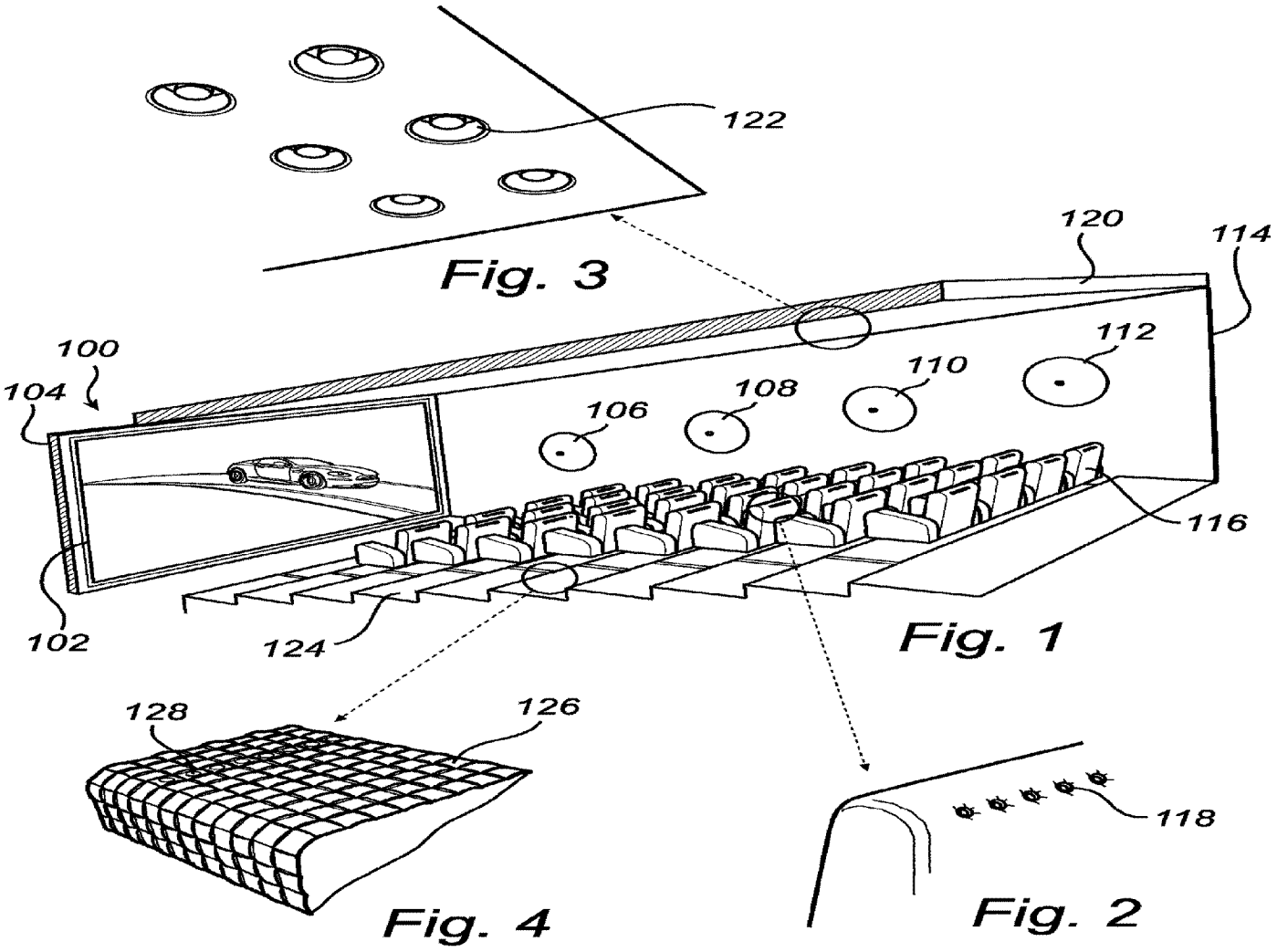
FIGS. 1-4 provide schematic illustrations of various aspects of an ambience lighting system installed in a structure, according to one embodiment of the present invention.

FIGS. 1-4 provide schematic illustrations of various aspects of an ambience lighting system installed in a structure, according to one embodiment of the present invention. FIGS. 1-4 illustrate a structure 100, in this example the structure 100 being a cinema, comprising a cinema display screen 102 arranged on the front wall 104 of the structure 100. An ambience lighting system installed in the structure 100 may comprise one or more external luminaires as illustrated in FIGS. 1-4 with light sources 106, 108, 110, 112, 118, 122, and 128. For example, a plurality of light sources such as e.g. wall washers 106, 108, 110, 112 may be arranged spaced apart on a right hand side wall 114 of the structure 100. A left hand side wall of the structure 100 may of course be provided with similar types of correspondingly arranged light sources. Within the structure 100, there may be provided a plurality of chairs 116. At least some of the chairs 116 may have one or more light sources 118 shown in FIG. 2, e.g. embedded in the textile of the chairs 116, possibly at the back of each chair (other placements are of course possible, such as within the arm rests of the chairs). Also, a roof 120 of the structure 100 may be provided with a material, e.g. plaster, configured to have light sources, as illustrated in FIG. 3 with embedded light sources 122. Additionally, the floor 124 of the structure 100 may be provided with a textile floor covering 126 having embedded light sources 128, as illustrated in FIG. 4. For embedding the light sources within the textile chairs/floor of the structure and/or the roof of the structure, different methods are known to the skilled person and possible within the scope of the invention. Furthermore, it is not necessary to include all of the above types of light sources within the ambience lighting system in the structure 100. Rather, a selected sub-set of the above described light sources may be used for providing the ambient lighting in the structure as provided according to the invention. Thus, during operation, the light output provided by those of the light sources 106, 108, 110, 112, 118, 122 and 128 that are present within the ambience lighting system contribute to the total ambient light effect provided by the ambience lighting system for illuminating at least parts of the structure 100.

The light sources 106, 108, 110, 112, 118, 122 and 128 present within the ambience lighting system may comprise any suitable luminaires capable of emitting coded light.

In one embodiment, the light output of at least some of the light sources of the ambience lighting system may be coded such that the light output comprises an individual identifier (ID) codes of the individual light sources, which is typically an embedded code emitted as a temporal sequence of modulations in the characteristics of the light emitted from the light source. As used herein, the terms "identifier" or "ID code" refer to any codes that allow sufficient identification of individual CL sources within the ambience lighting system. In one further embodiment, the identifier code may comprise a repeating sequence of N symbols (e.g. bits). As used herein, the term "symbol" applies not only to single bits, but also to multiple bits represented by a single symbol. Examples of the latter are multi-level symbols, where not only 0 and 1 exist to embed data, but multiple discrete levels. In this manner, the total light output of the ambience lighting system may contain a plurality of identifier codes, each originating from the individual CL source.

In other embodiments, additionally or alternatively to the individual ID, the coded light produced by a CL source may comprise other information regarding the light source, such as e.g. current light settings of the light source and/or other information.

The codes are embedded into the light outputs of the CL sources by modulating a drive signal to be applied to a light source in response to a particular code signal. There are various techniques for embedding a code into the light output of a light source (e.g. pulse width modulation, amplitude modulation, etc) which are known to people skilled in the art and, therefore, are not described here in detail.

In a preferred embodiment, the light sources of the ambience lighting system comprise light emitting diodes (LEDs), organic light emitting diodes (OLEDs), polymeric light emitting diodes (PLEDs), or inorganic LEDs because LEDs have much higher energy efficiency in comparison to conventional light bulbs which generally deliver at best about 6% of their electric power used in the form of light and because LED luminaires can be fabricated to produce CL, whereas other types of luminaires often need to be retrofit in order to be able to emit CL.

In an embodiment, the primary light-determining device displaying image content on the cinema display screen 102 (such a device not shown in FIGS. 1-4) may comprise a conventional TV without Ambilight. Alternatively, the primary light-determining device may comprise a (cinematic) movie projection system. In yet another embodiment of the system, the primary light-determining device is not an Ambilight TV but a Wake-Up Light where the ambient lighting system can be used to match the intensity of additional external luminaires to the light of the Wake-Up Light. For example, the external luminaires may be set up to generate a spatially variant pattern in association with the Wake-Up Light. As the Wake-Up Light does not provide a dynamic spatial variation by itself, the external lamps can be set up, e.g. to mimic a sunrise or sunset from left to right, exploiting the different localized light contributions throughout the room.

In another possible embodiment, the primary light determining device may comprise any other light generating device with which a at least one secondary light source is to be connected with the purpose that the secondary light source produces a light effect that matches the light of the primary device in a predetermined fashion.

Embodiments of the present invention relate to a method for calibrating the external light sources of the ambience lighting system installed in the structure 100 for providing an ambient light effect for the cinema display screen 102. The method is based on implementing the ambience lighting system in the form of one or more of coded light (CL) sources 106, 108, 110, 112, 118, 122 and 128. The method then includes processing one or more images of a scene being illuminated by the ambience lighting system to determine, based on the CL embedded into the light output of the individual CL sources, color and/or an intensity of the light generated by the individual CL source. The set of control data for controlling the CL sources to provide the desired ambient light effect is then based not only on the color and/or intensity of image content to be displayed on the cinema display screen, but also on the determined color and/or intensity of the light output of the individual CL sources.

Figure 5:
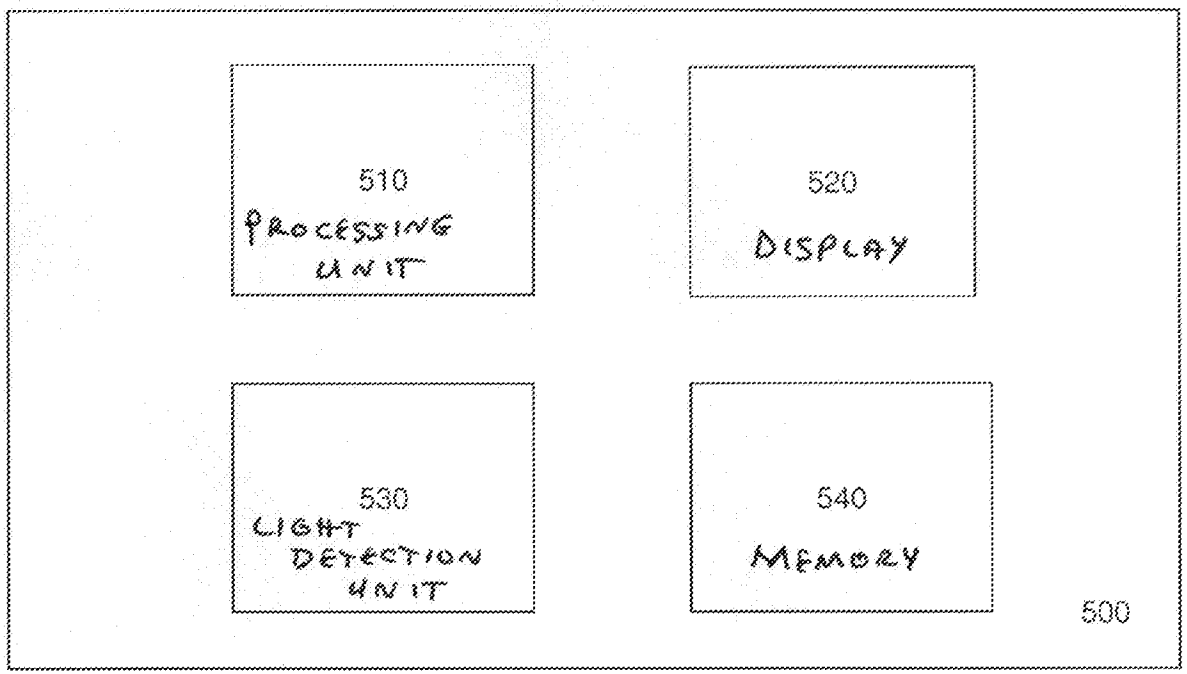
FIG. 5 is a schematic illustration of a control system, according to one embodiment of the present invention.

For at least calibrating, and possibly also controlling, the light sources of the ambience lighting system, a control system 500 is provided, as shown in FIG. 5 (the control unit is not shown in FIGS. 1-4). In an embodiment, the electronic components illustrated in FIGS. 1-4 and the components of the control system 500 may have wireless connectivity between them.

The control system 500 includes at least a processing unit 510 in a form of a microprocessor, microcontroller, programmable digital signal processor or another programmable device. Alternatively or additionally, the processing unit 510 may comprise an application specific integrated circuit, a programmable gate array or programmable array logic, a programmable logic device, or a digital signal processor.

In addition to the processing unit 510, the control system 500 may, optionally include one or more of a display 520, a light detection unit 530, and a memory 540. The display 520 could be configured for displaying e.g. a user interface for controlling the CL sources of the ambience lighting system or any of the results of the calibration performed on the ambience lighting system. The light detection unit 530 could comprise any light detection means, such as e.g. a camera, configured for acquiring one or more images of a scene, which images are then processed by the processing unit 510. The memory 540, possibly together with a specifically designated control (RF/WiFi) unit (not shown in FIG. 5) could be used for controlling the light sources. Where the control system 500 includes a programmable device such as the microprocessor, microcontroller or programmable digital signal processor mentioned above, the memory 520 could be used for storing computer executable code that controls operation of the programmable device when executed in the processing unit 510.

The control system 500 may be configured to communicate with at least some of the external luminaires of the ambient lighting system for allowing individual control of the luminaires. In an embodiment, the external luminaires could be connected to a local IP network by Ethernet cables, and the control system 500, such as e.g. an iPad, could communicate with the luminaires via a WiFi router connected to the same network. To that end, the control system 500 could use conventional WiFi discovery techniques to obtain the IP addresses of the luminaires, and then match the IP addresses to the IDs obtained from the coded light detected e.g. as a part of step 620, described below in association with FIG. 6. A connection to the means for displaying images/video sequences onto the cinema display screen 102 may also provided for controlling when to drive the external luminaires to emit ambient lighting.

While the control system 500 is illustrated as a single unit, persons skilled in the art will realize that functionality of the individual elements illustrated in FIG. 5 to be within the system 500 could also be distributed among several other units. Further, in various embodiments, the control system 500 could be included as a part of the ambience lighting system (i.e. as a part of a system further including the external luminaires themselves) and/or as a part of the entire cinema system (i.e., as a part of a system further including not only the external luminaires but also the cinema display screen).

Figure 6:
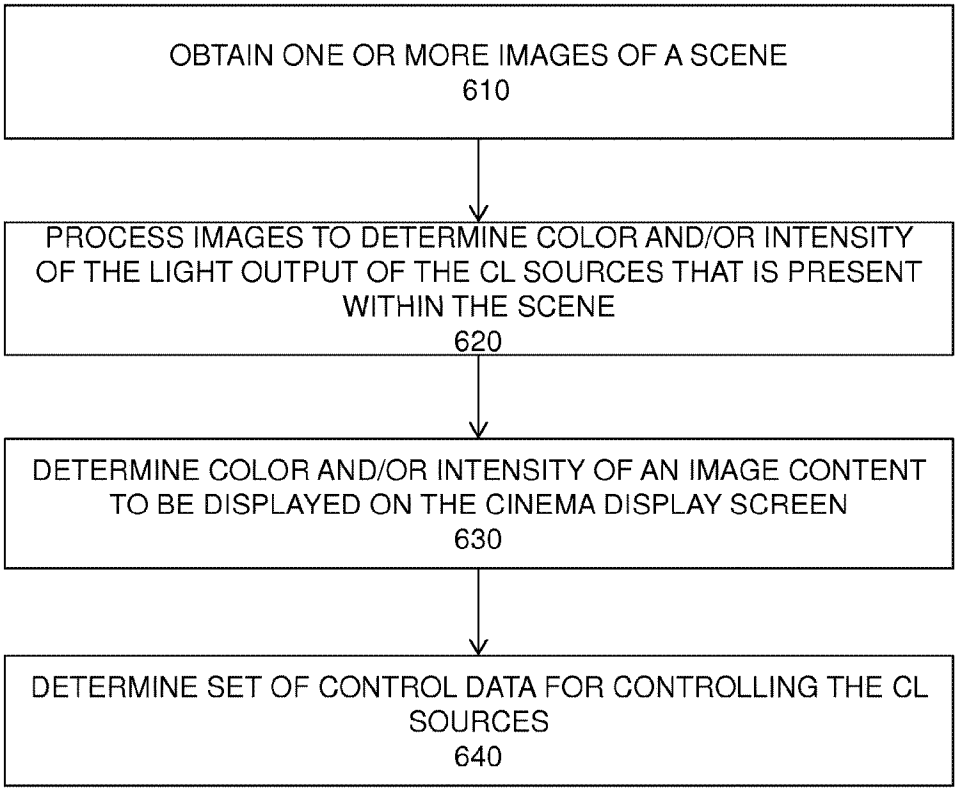
FIG. 6 is a flow diagram of method steps for calibrating an ambience lighting system, according to one embodiment of the present invention.

FIG. 6 is a flow diagram of method steps for calibrating the ambience lighting system installed in the structure 100, according to one embodiment of the present invention. For the sake of simplicity, it is first assumed that the ambience lighting system installed in the structure 100 includes only one light source, referred to herein as "the first light source 106" (of course, analogous discussions are applicable for any one of the other light sources shown in FIGS. 1-4, not necessarily for the light source 106). The method steps of FIG. 6 are performed by the processing unit 510. While the method steps are described in conjunction with the elements shown in FIGS. 1-5, persons skilled in the art will recognize that any system configured to perform the method steps, in any order, is within the scope of the present invention.

The method of FIG. 6 may begin in step 610 where the processing unit 510 obtains one or more images of a scene acquired by a camera, such as e.g. the camera 530 included within the control system 500 or a camera like the camera 530 but implemented as a stand-alone device which is not a part of the control system 500. The scene is selected to be such that at least a part of the scene includes at least a part of the light output (i.e., of the footprint) of a CL source to be calibrated, in this example—of the first light source 106. In further embodiments, the scene may also include at least parts of the actual first light source 106 and/or the cinema display screen 102. In such embodiments, the acquired images then include the images of the first light source 106 and/or the cinema display screen 102, respectively.

One purpose of acquiring the one or more images is to later detect the color and/or the intensity of the light output of the individual CL sources that is present within the scene. Thus, the minimum number of images acquired should be such that the acquired images allow such detection. Because various detection techniques are well-known, a person skilled in the art will recognize how many images are sufficient for carrying out the detection in a given setting. The minimum number of images depends e.g. on one or more of the types and the number of the light sources, the technique used for embedding the code into the light output of the light sources, the camera used, and the detection technique employed in processing the images. For example, if a rolling shutter camera is used, where different portions of the image sensor(s) of the camera are exposed at different points in time, only a single image is sufficient as the embedded code may be observable as alternating stripes in the image, as e.g. described in U.S. Pat. No. 8,248,467 B1, WO2012/127439A1, and U.S. 61/698,761. One the other hand, if a global shutter camera is used, where all portions of the image sensor(s) of the camera are exposed at the same time instances during a frame, and embedded codes comprise repeating sequences of N symbols, then, as described in WO2011/086501A1, at least N different images should be acquired, each image is acquired with a total exposure time comprising one or more exposure instances at different temporal positions within the repeating sequence of N symbols. Of course, more images may be acquired in order to e.g. improve the probability of detection of the light output of various light sources or to track changes in the light contributions of the different light sources over time.

The method of FIG. 6 is applicable for enabling a user to control those CL sources within an ambience lighting system that actually provide light contribution to a scene at the moment that the one or more images of the scene are acquired. Therefore, in an embodiment, in order to provide the user with control icons for all CL sources present within the ambience lighting system, the methods described herein may include the processing unit 510 providing a command to all of the CL sources within the ambience lighting system to turn on the CL sources so that each CL source provides sufficient light contribution to the scene during the short time when the one or more images are acquired in step 610.

After the one or more images have been acquired, the method proceeds to step 620, where the processing unit 510 can process at least some of the acquired images to determine the color and/or the intensity of the light output of the first light source 106 using any of the known detection techniques. To that end, in one embodiment, the processing unit 510 may be configured to identify, from the acquired images, the ID code that was embedded in the light output of the first light source 106 and, based on the identified ID code determine what the color and/or intensity of that light source is (using e.g. a look-up table). In other embodiments, the values of the current color and/or intensity of the light output emitted by the various CL sources may be embedded into their light output. In this case, the processing unit 510 may have access to the protocol that is used to encode the messages in the coded light or may be capable of recognizing the used protocol, in order to be able to decode the message in the encoded light.

Figure 7:
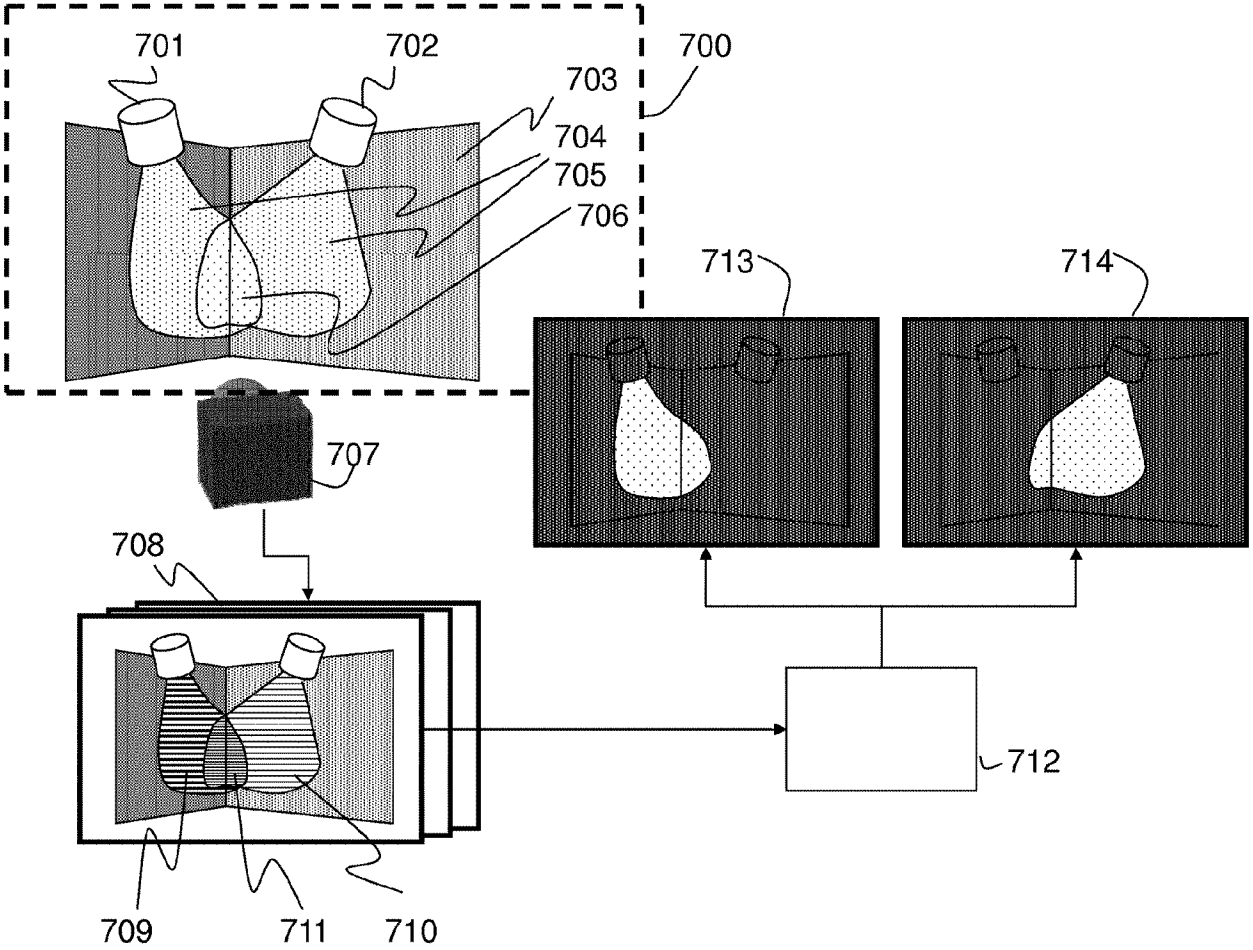
FIG. 7 is a schematic illustration of footprint localization on the basis of coded light when two light sources provide light contributions to a scene, according to one embodiment of the present invention.

The ability to separately localize the light footprint of individual CL sources with a camera allows obtaining the color, intensity and distribution of the light effect generated by each of the sources within the frame of the image. FIG. 7 provides a schematic illustration of footprint localization on the basis of coded light, according to one embodiment of the present invention. As shown with an inset 700 (identified by the dashed lines), the footprint localization of FIG. 7 illustrates a first light source 701 and a second light source 702 illuminating a scene 703. The illumination provided by the first light source 701 results in a light footprint 704 and the illumination provided by the second light source 702 results in a light footprint 705, the two footprints overlapping in the area 706. A camera 707, such as e.g. the camera 530 included within the control system 500 or a camera like the camera 530 but implemented as a stand-alone device which is not a part of the control system 500, is configured to acquire one or more images 708 of the scene 703. Each of the two light sources 701 and 702 provide a different CL signal, which can be seen in the images as a CL signal 709 from the first light source 701 and a CL signal 710 from the second light source 702, with the area 711 illustrating the captured sum of the CL signals 709 and 710. A control system 712, which could be implemented as the control system 500, obtains the acquired images in step 610 of FIG. 6, and processes the images (step 620) to determine a calculated image 713 of the light footprint of the first light source and a calculated image 714 of the light footprint of the second light source. For example, if the camera 707 is a rolling shutter camera, then the different CL signals 709 and 710 will give rise to different spatial or spatiotemporal patterns in the captured frames 708, which allow the calculation of the individual light contributions (i.e., the color and/or the intensity) of the different CL sources.

In step 630, which could take place before or simultaneously with the step 610 and/or 620, the processing unit 510 determines the color and/or the intensity of an image content to be displayed on the cinema display screen.

The method may end in step 640, where the processing unit 510 determines the set of control data for controlling the first light source 106 to provide the ambient light effect based on the color and/or the intensity of the light output provided by that light source, as determined in step 620, and based on the color and/or the intensity of the image content to be displayed on the cinema display screen, as determined in step 630. In this manner, the RGB driving signals for each of the CL sources of the ambient lighting system can be corrected with, or matched to, the color and/or intensity of the corresponding image content to be displayed on the cinema display screen. In the absence of such a correction, the light of the external luminaires will generally tend to appear too bright or too dark, depending e.g. on the distance to the illuminated surface and/or on the tint of the illuminated surface.

In a further embodiment of the system, the driving parameters of each external luminaire may also be adjusted such that the apparent light color in the camera image matches the apparent light color of the image content to be displayed on the cinema display screen. Using such a relative color matching alleviates the need for the processing unit 510 to perform an absolute assessment of the apparent colors. In case the color primaries of the light sources sufficiently match the primaries of the camera, assessment and parameter adjustment could be performed on the multiple RGB colors simultaneously. In case the primaries of the light sources do not match the camera primaries, e.g. cyan, magenta, yellow (CMY), such measurement could be performed for the CMY primaries sequentially.

In an embodiment, at least part of the set of control data determined in step 640 may be stored in the TV or cinema projection system that instructs image content to be displayed on the cinema display screen and may be made accessible to one or more other (mobile) remote control devices to enable manipulation of the control parameters. Alternatively or additionally, at least part of the determined set of control data may be stored in additional memory location and may be made accessible to one or more other (mobile) remote control devices to enable manipulation of the control parameters. Such an additional memory location could be e.g. a part of a bridge, other (audio-visual) device or system, or provided by an online service (cloud).

In an embodiment, the processing unit 510 may be configured to provide a user interface for displaying to a user the ambient effects on the display 520. For example, the ambient effect may be rendered for the user on the display 520 prior to, during or after calibration. The rendering result can either be an image or a sequence of images, such as e.g. an animation of the rendered effect in association to the momentary content displayed on the cinema display screen.

In an embodiment, the determination of step 640 also takes into consideration the location of the CL source with respect to the cinema display screen, thus allowing the calibration to correct for the distance between the cinema display screen and the CL sources. The location may be determined e.g. by selecting the scene of which images are acquired to be such that the cinema display screen is included in the scene and determining the location of the first light source 106 with respect to the cinema display screen based on an image of the cinema display screen and the footprint or/and the image of the first light output within the one or more images. The information determined in steps 620 and 630 may then be combined with the location of the cinema display screen in the acquired images in determining the correct driving parameters for the external luminaires given their location relative to the screen.

Figure 9:
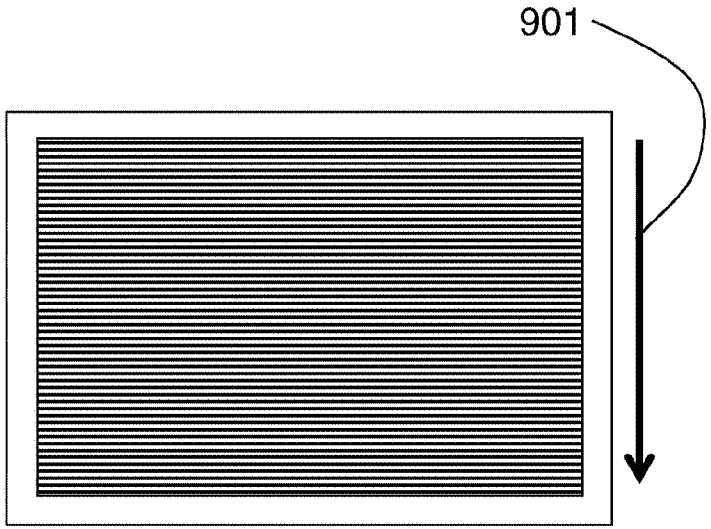
FIG. 9 is a schematic illustration of a predetermined dynamic pattern for robust camera-based recognition and localization, according to one embodiment of the present invention.
Figure 8:
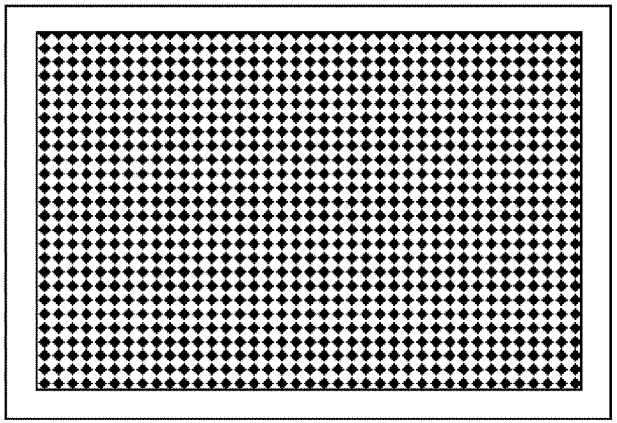
FIG. 8 is a schematic illustration of a predetermined static pattern for robust camera-based recognition and localization, according to one embodiment of the present invention.

The processing unit 510 may be configured to identify the cinema display screen within the acquired images in several different manners. In one embodiment, the identification of the cinema display screen may be based the appearance of the device in an image (e.g., if the approximate shape of the cinema display screen is known to the processing unit 510, so that the processing unit can recognize presence of that shape in the acquired images). In another embodiment, the identification of the cinema display screen may be based on a predetermined static pattern, e.g. as shown in FIG. 8, that appears on the screen during calibration. The pattern should be such that the processing unit 510 is able to unambiguously recognize the pattern in a camera image and extract sufficient geometric information from it. In yet another embodiment of the invention, the identification of the cinema display screen may be based on a dynamic pattern that appears on the screen during calibration, as shown in FIG. 9, where the arrow 901 indicates a possible motion direction. This can be a pattern that is easily recognized by the coded-light detection algorithm. In still another embodiment, the identification of the cinema display screen may be based on static or dynamic pattern that is generated by the ambience lighting system itself.

When large scale ambience lighting systems are employed, observable time delays may cause an unacceptable 'late' response of the light sources in relation to the image content. Therefore, in an embodiment, the determination of step 640 also takes into consideration the time delay with which a particular CL source responds to an instruction to start emitting desired ambient effect. To that end, the processing unit 510 may be configured for determining the time delay indicative of a time difference between a time instance when an instruction for controlling the first light source 106 is provided and a time instance when the first light source 106 provides the ambient light effect. In other words, the time delay of a light source may be seen as the time between a first, 'desired' time instance of a target ambient effect and second, 'erroneous' time instance at which the external luminaire responds. The delay of light sources in a networked system is generally due to the communication network and not due to the LED lamps themselves. Both in wired and in wireless networks, a large physical distance of an external luminaire to a central unit issuing instructions to start emitting the ambient effect can be a source of such delay, as the connection may have to pass multiple bridging network elements. However, in the context of the present invention, the precise source of the delay is irrelevant. What is relevant is that the processing unit 510 is capable of determining the time delay for each of the external luminaires of the ambient lighting system and make sure that the time delay is correctly accounted for in the set of control data for the luminaires.

In embodiments where the central unit issuing instructions to emit ambient light effect is implemented in or near the cinema display screen, which is typical for the implementations of the ambience lighting systems, and where the location of the first light source with respect to the cinema display screen is determined (e.g. by selecting the scene to include the cinema display screen, as described above), the time delay may be determined based on the distance between the first light source and the cinema display screen determined from the acquired images.

When a rolling-shutter camera is used to acquire images, the relatively high time resolution of an electronic rolling-shutter image capture allows such delays to become visible as spatial shifts of the associated light captured light phenomena. In this manner, automatic means can be provided for calibrating the ambience lighting system by localizing the light from external luminaires in relation to the location of the cinema display screen and determining the correct driving parameters for the external luminaires given their location relative to the screen and response delay relative to the displayed image content. Such calibration can ensure the correct or best local approximation of the desired ambient effect both in intensity and/or color as well as in time.

In case when both the cinema display screen 102 as well as at least one external luminaire appear in the camera's field of view such that the time delay can be assessed from the difference between the associated appearance of the light with one or more camera frames. In case when the primary system is a projection system, a sequence of predetermined patterns can be generated. In case the primary system generates a continuous range of gray values by way of a sequence of binary subframes, e.g. using switching micromirrors, a predetermined sequence of subframes can be such that the display provides temporal information at the time resolution of the subframe rate, or mirror-switch frequency rather than the frame rate at which the normal images are projected. Any of the external luminaires can produce a produce a predetermined change in color, intensity or encoded light information upon a predetermined trigger from the primary system. Any time difference will cause a spatial shift between the cinema display screen and the secondary light effect which can be reported back as data to the user or directly fed back to the system to pre-compensate the driving signal of the associated external luminaire.

Figure 10:
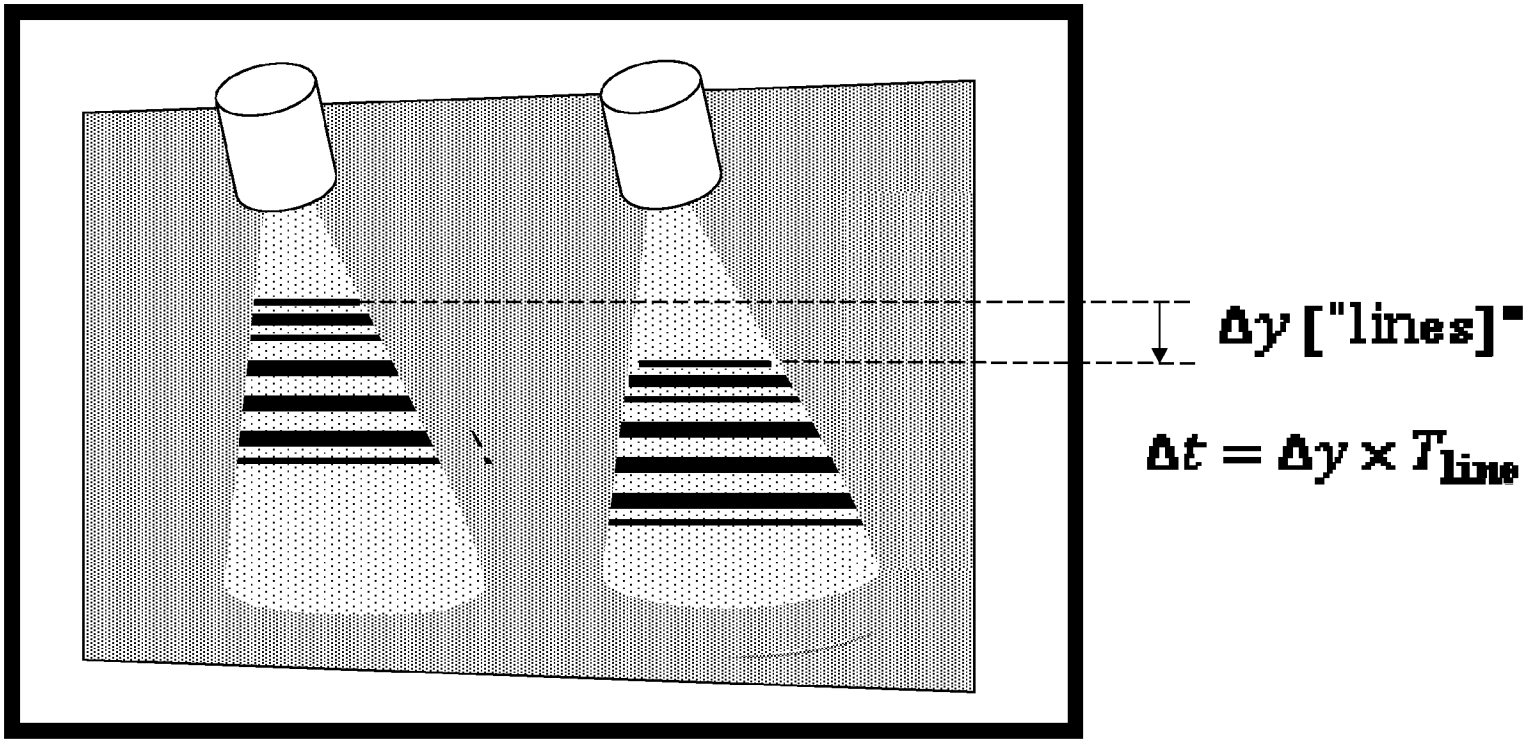
FIG. 10 provides an illustration of the effect of a time delay between two CL sources on a spatial pattern captured with a rolling-shutter camera, according to one embodiment of the present invention.

In an embodiment, the primary light generating system may be not the cinema display screen but another lamp driven by the projection system. Once its delay is known or even pre-compensated, that lamp can serve as a reference (i.e., as the cinema display screen) for another external luminaire in the same field of view. This way, the timing calibration of all external luminaires can be performed in successive order as the operator moves progressively further away from the cinema display screen 102, as shown in FIG. 10. FIG. 10 provides an illustration of the effect of a time delay between two CL sources on a spatial pattern captured with a rolling-shutter camera. In the example of FIG. 10, both light sources are driven with the same signal from a central control unit, yet each one of the light sources responds with a different delay.

In an embodiment, a time reference may be provided to the processing unit 510, e.g. by the display generating system via a (wireless) network connection. The processing unit 510 may then determine the temporal difference between received reference trigger signal and observed screen content, and use the determined difference to establish the time delay due to the communication link. This way any of the external luminaires of the ambience lighting system can be observed individually with the camera to establish the time delay with respect to the reference trigger signal.

Embodiments of the present invention can be applied to provide a fully automated configuration and calibration of a system of wirelessly controllable luminaires, e.g. in connection with an Ambilight TV, on the basis of a camera-equipped (mobile) device such as an iPad. Moreover, embodiments of the invention allow to automatically configure multiple controllable external luminaires to provide an Ambilight effect to TV sets that are not equipped with Ambilight. The ideas described herein can also be used to automatically configure an ambience lighting system that is setup to dynamically extend the cinematic projection. In this manner, complex installation and calibration issues can be resolved, as the camera-based detection of CL can provide lamp identification, localization and quantification of the individual light-footprints, color calibration and provide response-delay information.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processing unit 510 described herein.

While the forgoing is directed to embodiments of the present invention, other and further embodiments of the invention may be devised without departing from the basic scope thereof. For example, aspects of the present invention may be implemented in hardware or software or in a combination of hardware and software. Therefore, the scope of the present invention is determined by the claims that follow.

The invention claimed is:

1. A method for calibrating an ambience lighting system comprising at least a first light source for providing an ambient light effect in an environment comprising the ambience lighting system and a cinema display screen, the first light source configured for providing a first light output comprising a first code, the first code being embedded into the first light output as a first sequence of modulations in one or more characteristics of said first light output, the method comprising:

after obtaining one or more images of a scene being illuminated by the ambience lighting system, the scene comprising at least part of the cinema display screen and the first light output; processing the one or more images to determine, based on the first code embedded into the first light output, at least one of a color and an intensity of the first light output generated by the first light source, determining at least one of a color and an intensity of an image content to be displayed on the cinema display screen;

adjusting a set of control data for controlling the first light source to provide the ambient light effect based on the determined at least one of the color and the intensity of the first light output generated by the first light source and on the determined at least one of the color and the intensity of the image content to be displayed on the cinema display screen.

2. The method according to claim 1, wherein the scene further comprises the cinema display screen, the method further comprising processing the one or more images to determine a location of the first light source with respect to the cinema display screen based on an image of the cinema display screen and the first light output within the one or more images.

3. The method according to claim 1, wherein the scene further comprises the cinema display screen and the first light source, the method further comprising processing the one or more images to determine a location of the first light source with respect to the cinema display screen based on an image of the cinema display screen and an image of the first light source within the one or more images.

4. The method according to claim 2, wherein the set of control data for controlling the first light source is determined further based on the location of the first light source with respect to the cinema display screen.

5. The method according to claim 1, wherein determining the set of control data comprises determining a time delay indicative of a time difference between a time instance when an instruction for controlling the first light source is provided and a time instance when the first light source provides the ambient light effect using the determined set of control data.

6. The method according to claim 1, further comprising providing an instruction for controlling the first light source to provide the ambient light effect using the determined set of control data.

7. A non-transitory computer readable medium containing computer instructions stored therein for causing a computer process to perform the steps of the method according to claim 6.

8. A control system configured for carrying out the steps of the method according to claim 6.

9. An ambience lighting system for a cinema display screen, the system comprising a control system configured for carrying out the steps of the method according to claim 6, and at least a first light source connected to the control system, the first light source configured for providing a first light output comprising a first code, the first code being embedded into the first light output as a first sequence of modulations in one or more characteristics thereof.

10. A cinema system comprising a cinema display screen for displaying an image content, the system comprising:

an ambience lighting system which comprises at least a first light source for providing an ambient light effect in an environment comprising the ambience lighting system and the cinema display screen, the first light source being configured for providing a first light output comprising a first code, the first code being embedded into the first light output as a first sequence of modulations in one or more characteristics of said first light output;

a control system configured for:

obtaining one or more images of a scene being illuminated by the ambience lighting system, the scene comprising at least part of the cinema display screen, and the scene further comprising at least the first light output;

processing the one or more images to determine, based on the first code embedded into the first light output, at least one of a color and an intensity of the first light output provided by the first light source;

determining at least one of a color and an intensity of an image content to be displayed on the cinema display screen;

adjusting the a a set of control data for controlling the first light source to provide the ambient light effect based on the determined at least one of the color and the intensity of the first light output provided by the first light source and on the determined at least one of the color and the intensity of the image content to be displayed on the cinema display screen; and, providing an instruction for controlling the first light source to provide the ambient light effect using the determined set of control data.

11. The system according to claim 8, further comprising a camera configured for acquiring the one or more images of the scene, wherein the camera includes a rolling-shutter image sensor.

12. The method according to claim 1, wherein the step of determining, based on the first code embedded into the first light output, at least one of a color and an intensity of the first light output provided generated by the at least one first light source, includes localizing a light footprint of respective light sources to obtain the at least one color and intensity and a distribution of light generated by each of the respective sources within a frame of the one or more image.

* * * * *